US007204345B2

(12) United States Patent
Grant

(10) Patent No.: US 7,204,345 B2
(45) Date of Patent: Apr. 17, 2007

(54) SCAFFOLDING BRACKET

(76) Inventor: Kevin Anthony Grant, 390 Kensington Street, Winnipeg, Manitoba (CA) R3J 1J5

( * ) Notice: Subject to any disclaimer, the term of this patent is extended or adjusted under 35 U.S.C. 154(b) by 345 days.

(21) Appl. No.: 10/940,685

(22) Filed: Sep. 15, 2004

(65) Prior Publication Data

US 2006/0070802 A1 Apr. 6, 2006

(51) Int. Cl.
*E04G 3/00* (2006.01)
*E04G 3/20* (2006.01)

(52) U.S. Cl. ..... 182/82; 248/235

(58) Field of Classification Search ..... 182/82, 182/150, 206; 248/235, 238, 210, 211, 244, 248/245

See application file for complete search history.

(56) References Cited

U.S. PATENT DOCUMENTS 1,305,922 A * 6/1919 Moller ..... 248/238
2,605,074 A * 7/1952 Bucsko et al. ..... 248/235
3,148,857 A * 9/1964 Hutchison ..... 182/82
3,195,531 A * 7/1965 Groff ..... 248/235
3,198,470 A * 8/1965 Owens ..... 182/82
4,368,800 A * 1/1983 Campbell ..... 182/82
4,957,185 A * 9/1990 Courchesne et al. ..... 182/150
5,535,974 A * 7/1996 Savitski ..... 248/235
5,727,647 A * 3/1998 Brantley, Jr. ..... 182/82
6,273,381 B1 * 8/2001 Riblet ..... 248/235
6,422,339 B1 * 7/2002 Wisler ..... 182/82

* cited by examiner

*Primary Examiner*—Hugh B. Thompson, II
(74) *Attorney, Agent, or Firm*—Ryan W. Dupuis; Adrian D. Battison; Michael R. Williams

(57) ABSTRACT

A bracket for attachment to an upright scaffolding member has a rigid body with a front hook and rear hook thereon for engaging opposing front and rear faces of the upright scaffolding member. A support arm projects horizontally forward from the rigid body beyond the front hook for supporting an auxiliary platform thereon. A retainer member is movable on the body between an unlocked position in which an area between the hooks for receiving the upright scaffolding member therein is unobstructed and a locked position for engaging the upright scaffolding member in which the retainer member is immovable in the direction of engagement of the retainer member with the upright scaffolding member to prevent accidental release thereof.

14 Claims, 6 Drawing Sheets

SCAFFOLDING BRACKET

FIELD OF THE INVENTION

The present invention relates to a scaffolding bracket for securement to an upright scaffolding member for supporting an auxiliary platform member thereon when used with another scaffolding bracket of similar configuration.

BACKGROUND

Various types of scaffolding systems are known in which elongate platform surfaces are supported by various beams and upright poles for supporting workers thereon at an elevated position. Due to the limited spaced on the platform surface for storage of materials and the like it is desirable to provide additional platform surface area for storage and for greater accessibility to the area user are working on. Scaffolding systems are also very limited in their ability to be placed around obstacles projecting from an upright surface along which the scaffolding system is to span.

U.S. Pat. No. 4,368,800 to Campbell discloses an example of a scaffolding apparatus in which a pair of brackets is used for securement to spaced apart uprights for supporting planking material spanning thereacross. The brackets each use a pair of opposing hooks for engaging about opposing sides of the upright to support the bracket and planking material thereon on the upright. Angular deflection of the bracket is sufficient to release the bracket from the upright. Accordingly a retainer member is provided which extends about a rear of the upright opposite a lower most hook engaging a front face of the upright. For releasing, the retainer member is biased against a spring so it can be pulled away rearwardly from the rear face, along the direction of engagement, to a released position. Sliding movement and biasing of the retainer member is along the same direction as the engagement of the retainer member with the rear face and accordingly the retainer member is limited to the force of the biasing mechanism in its engagement to prevent angular deflection of the bracket relative to the upright.

SUMMARY

According to one aspect of the present invention there is provided a scaffolding system comprising:

a plurality of spaced apart uprights;

a carriage supported for sliding movement along the uprights;

a horizontally extending main platform member supported on the carriage;

a pair of brackets securable to the carriage at horizontally spaced positions;

an auxiliary platform member spanning the pair of brackets.

The pair of brackets preferably extend away from the uprights in a direction opposite to the main platform member.

When there is provided a pair of main platform members spaced from one another and spanning respective carriages on respective uprights and the pair of brackets are secured to different carriages which support different main platform members thereon, the auxiliary platform member preferably spans between the pair of main platform members.

According to a second aspect of the present invention there is provided a bracket for attachment to an upright scaffolding member, the bracket comprising:

a rigid body;

a front hook on the rigid body for engaging a front face of the upright scaffolding member;

a support arm projecting horizontally forward from the rigid body beyond the front hook;

a rear hook on the rigid body, spaced upwardly and rearwardly from the front hook, for engaging a rear face of the upright scaffolding member;

a retainer member movable between an unlocked position in which an area between the hooks for receiving the upright scaffolding member therein is unobstructed and a locked position for engaging the upright scaffolding member in which the retainer member is immovable in the direction of engagement of the retainer member with the upright scaffolding member.

A scaffolding system is provided according to the present invention in which auxiliary platform surfaces can be secured to a moving carriage for movement with the carriage when the scaffoldings system comprises uprights supporting a carriage and a main platform thereon. The brackets are well secured because each is provided with a retainer member moveable into engagement with the upright upon which the bracket is secured in a direction which is perpendicular to the directional force of the retainer member engaging the upright. The retainer member in this instance adequately secures the bracket against angular rotation which might release the bracket, limited only by the shear force of the retainer member itself.

The retainer member is preferably moveable perpendicularly to the direction of engagement of the retainer member with the upright scaffolding member.

When the retainer member engages a rearward facing edge of the upright scaffolding member, the retainer member is preferably positioned nearest the front-hook.

When the retainer member engages a forward facing edge of the upright scaffolding member, the retainer member is preferably nearest to the rear hook.

Accordingly, when the retainer member comprises a first member engaging a rearward facing edge of the upright support member and a second member engaging a front facing edge of the upright scaffolding member, preferably the first member is located adjacent the front hook and the second member is located adjacent the rear hook.

When there is provided an upright scaffolding member which is generally C-shaped in cross-section, the retainer member preferably engages an inner face of the upright support member adjacent one of the hooks. Preferably, the retainer member comprises a first member engaging an inner face of the upright support member adjacent the front hook and a second member engaging an inner face of the upright support member adjacent the rear hook.

The retainer member may comprise a threaded member, moveable axially by rotation thereof.

Alternatively, the retainer member may be slidable perpendicularly to the direction of engagement of the retainer member with the uprights scaffolding member. In this instance, the retainer member is preferably biased into a locked and engaged position with the upright scaffolding member.

There may be provided a mounting aperture at each end of the support arm for mounting a chain extending therebetween to hold down the auxiliary platform member.

BRIEF DESCRIPTION OF THE DRAWINGS

In the accompanying drawings, which illustrate exemplary embodiments of the present invention.

DETAILED DESCRIPTION

Figure 1:
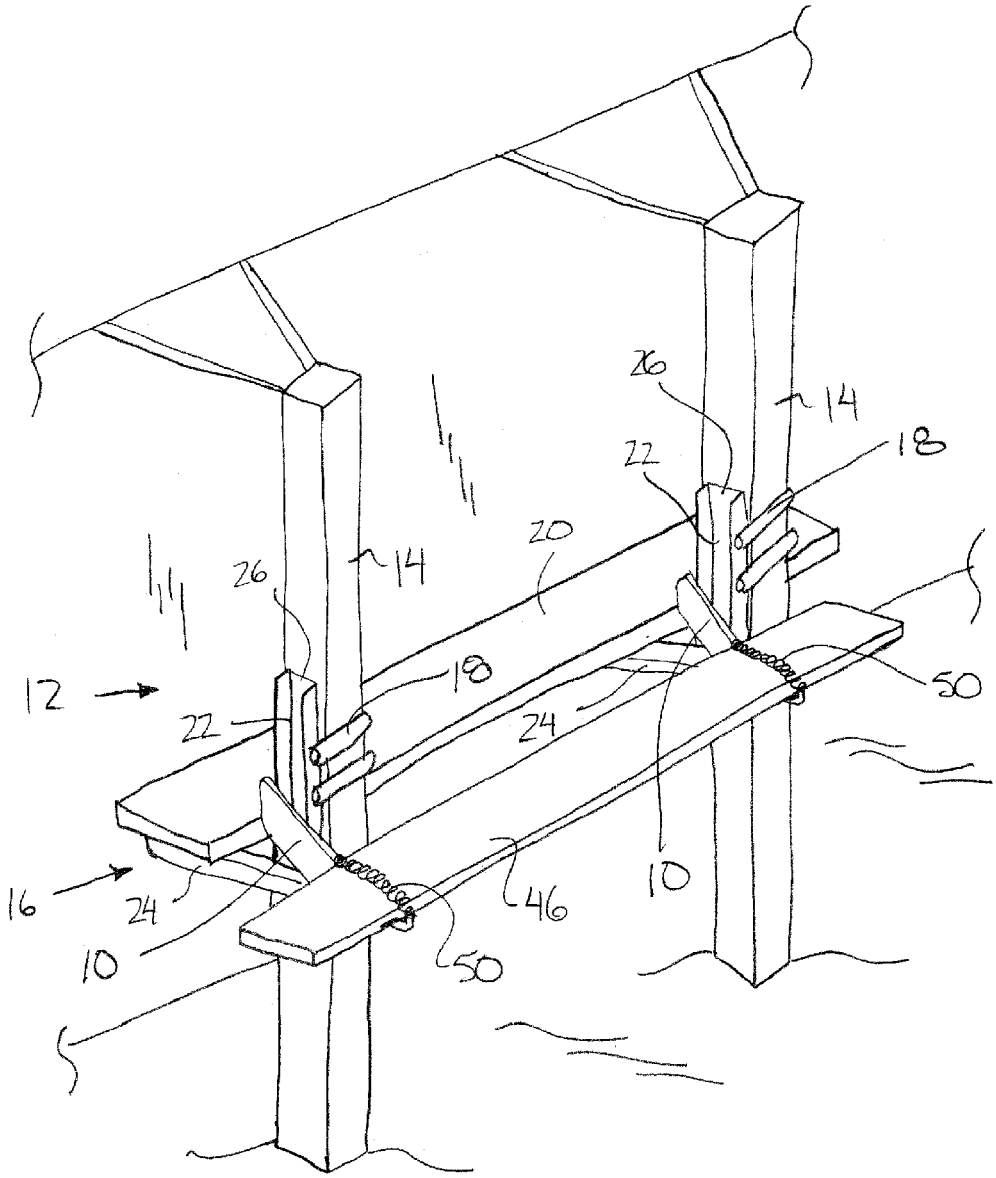
FIG. 1 is a perspective view of the scaffolding system in which a pair of the brackets supports an auxiliary platform surface thereon.
Figure 2:
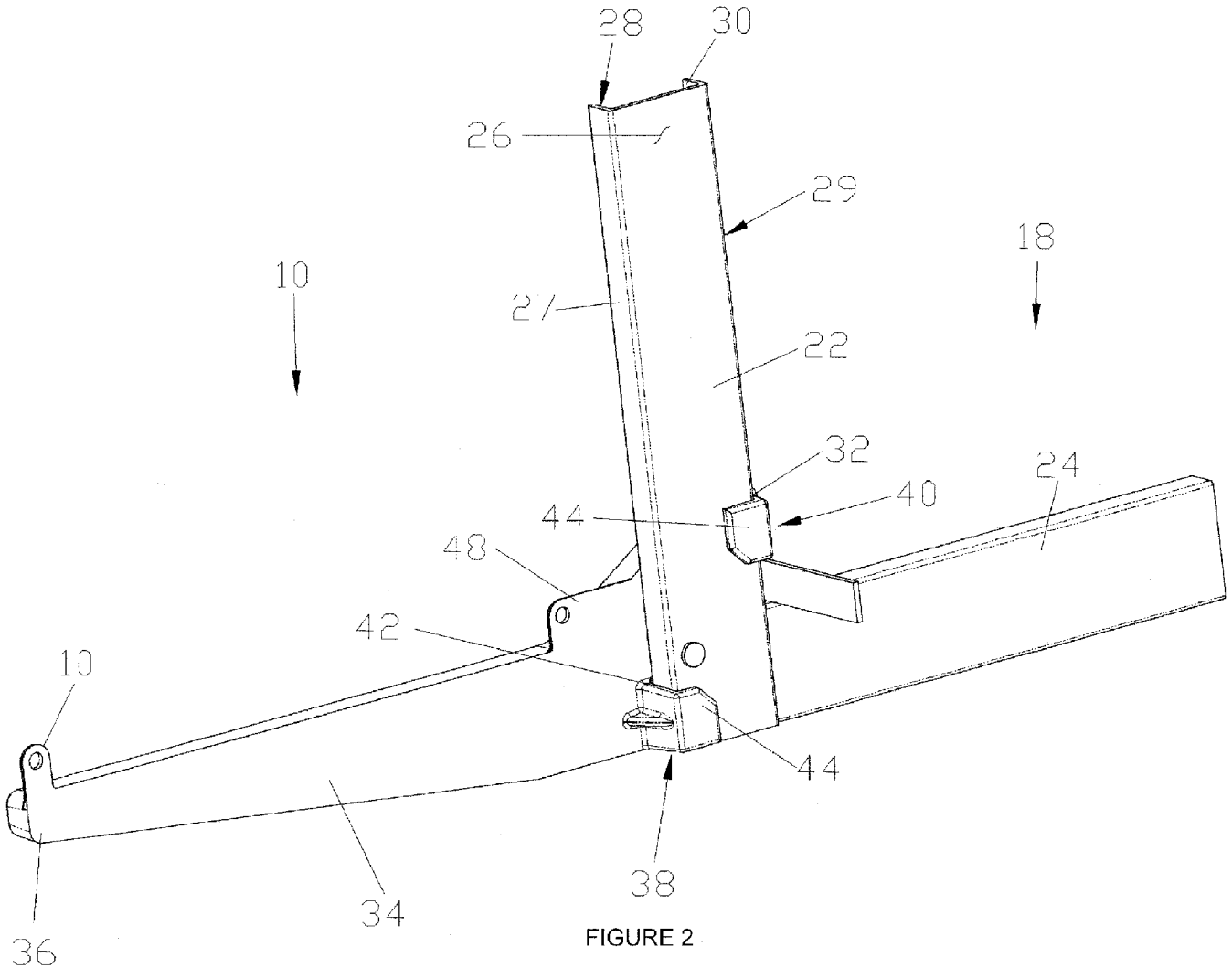
FIG. 2 is a perspective of an inner side of the bracket shown mounted on an upright.
Figure 3:
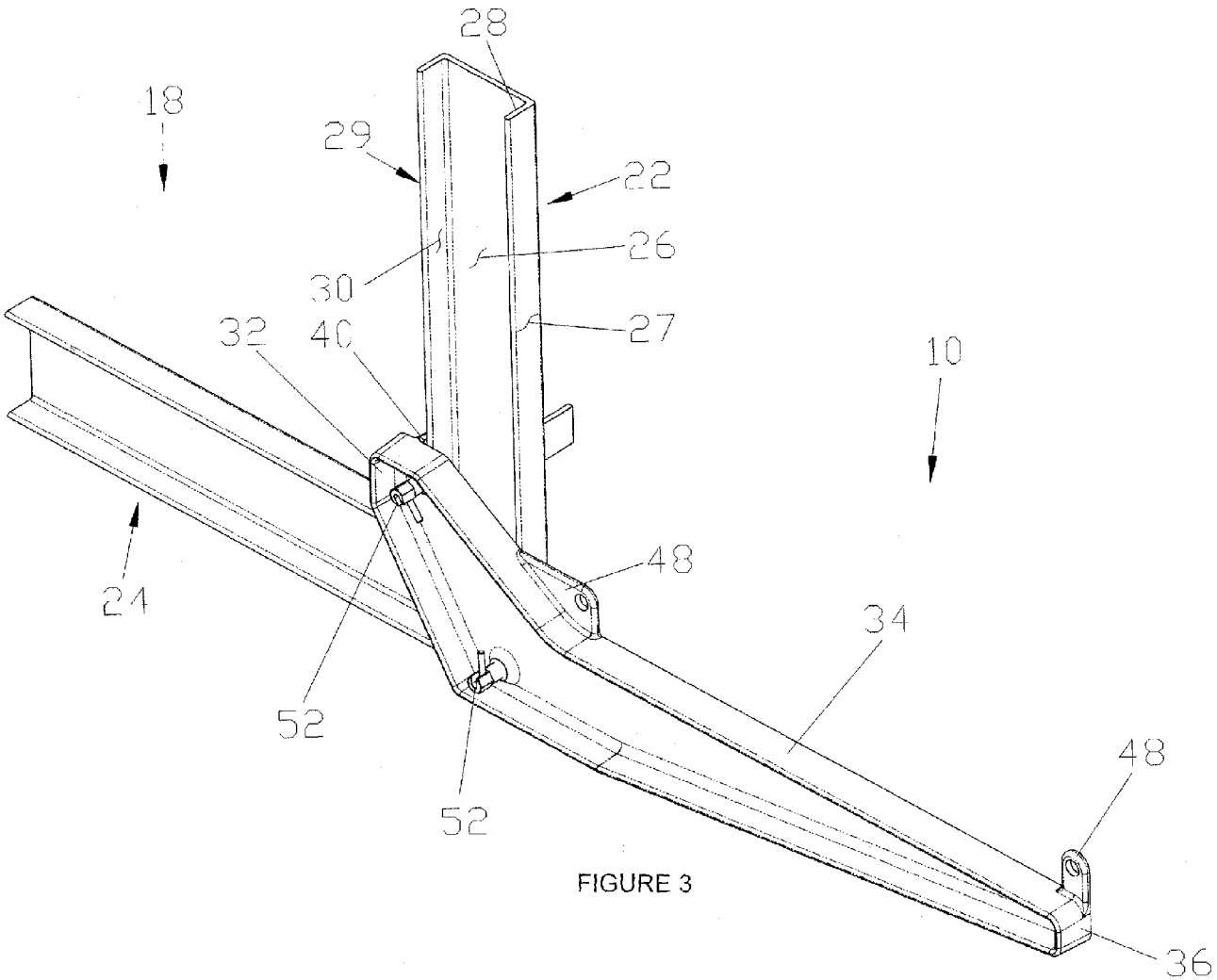
FIG. 3 is a perspective of an outer side of the bracket mounted on the upright.
Figure 4:
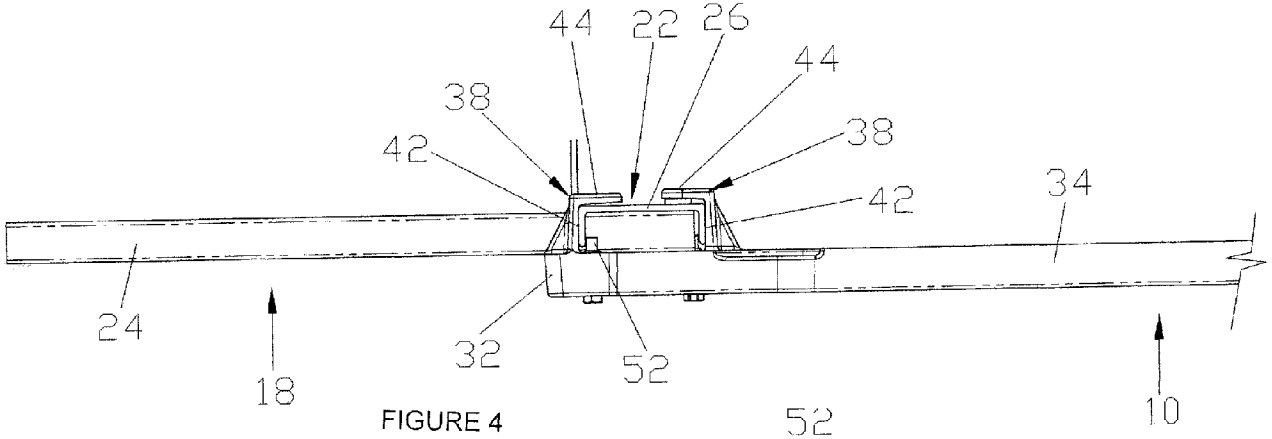
FIG. 4 is a top plan view of the bracket mounted on the upright.

Referring to the accompanying drawings, there is illustrated a scaffolding bracket generally indicated by reference numeral 10. The bracket 10 is particularly suited for use with a scaffolding system 12 as shown best in FIG. 1.

The scaffolding system 12 includes a plurality of main uprights 14 which are vertically oriented at spaced apart positions. A carriage 16 is slidably supported on the main uprights in the form of a pump head 18 supported on each upright for supporting a main platform member 20 spanning horizontally across the carriage 16 between the uprights 14.

The pump heads 18 each include a suitable raising and lowering mechanism for jacking along the respective uprights for adjusting elevation of the main platform member 20. Each pump head includes an upright support 22 which extends vertically along side the main upright for relative movement there between and a horizontal support 24 projecting from the upright support horizontally for supporting the main platform member 20 thereon. Each of the upright supports 20 of the pump heads comprise a C-channel having a base portion 26 against the main upright 14, a front face 27 facing away from the main platform and including a corresponding rearward facing inner face 28, and a rear face 29 facing the main platform and including a corresponding opposing inner face 30.

Each bracket 10 includes a rigid body which is configured for anchoring to the corresponding upright support 22 at a rear end 32 and which includes a support arm 34 projecting horizontally forward to a free front end 36. A front hook 38 and a rear hook 40 are spaced apart from one another adjacent the rear end 32. The hooks 38 and 40 confront one another at a suitable lateral spacing for receiving the upright support 22 there between.

The engaging faces 42 of the hooks are parallel with one another for engaging the opposing parallel sides of the C-channel forming the upright support 22. The rear hook 40 is spaced upwardly and rearwardly in relation to the front hook when the support arm 34 extends horizontally. Each of the hooks includes a perpendicular hook portion 44 lying perpendicular to the engaging faces 42 for wrapping around the edges of the C-channel. The hooks are suitably supported by gussets opposite the engaging faces 42 thereof for additional structural support. The front hook 38 has its engaging face 42 facing rearwardly for engaging the corresponding front face 37 of the C-channel. Similarly the rear hook includes a forward facing engaging face 42 suitable for engaging the rear face 29 of the C-channel.

The support arm 34 includes a flat upper surface having a suitable length for receiving a standard width piece of lumber thereon which acts as an auxiliary platform member 46. The support arm includes raised protrusions 48 at each end thereof which includes a mounting aperture therein for attaching a safety chain 50 across the auxiliary platform member 46 supported in the support arm.

Each of the hooks 38 and 40 includes an associated retainer member 52 which prevents angular deflection of the bracket relative to the upright support 22 for added safety in ensuring that the bracket remains secured on the scaffold system. Two embodiments of the retainer member 52 are shown in the drawings, but the common features of each will first be described herein.

Each retainer member 52 comprise a pin which is moveable in an axial direction of the pin through the body of the bracket parallel to the engaging faces 42 of the hooks towards and away from the hook portion 44 at the free end thereof. The retainer member 52 is spaced from the corresponding engaging face 42 of the hook sufficiently to receive the thickness of the sheet metal forming the C-channel of the upright support 22 between the retainer 52 and the face 42. The retainer member 52 thus engages the corresponding inner face 28 or 30 adjacent the associated hook at the same elevation as the associated hook so that the retainer member 52 and the engaging face 42 of the associated hook are directly opposite one anther to retain one of the side portions of the C-channel there between.

Turning now to the embodiment of FIGS. 1 through 4, the retainer member includes an externally threaded body 54 including a bore therethrough which slidably receives a pin 56 which is biased towards an engaged position overlapping a portion of the upright support 22. A protrusion at the outer side of the sliding pin 56 permits a user to grasp the sliding pin 56 and force the pin against the biasing force until the area between the confronting hooks 38 and 40 is unobstructed whereby rotation of the bracket permits the hooks to be released from the corresponding sides of the C-channel forming the upright support 22 for removing the bracket from the upright. The nearest edges of the hook portions 44 of the hooks are angled so as to be parallel with one another. Spacing between the nearest edges is measured diagonally, perpendicular to the parallel edges, to be approximately equal to the width of the upright support for receiving the support therebetween when the bracket is angularly deflected.

Figure 6:
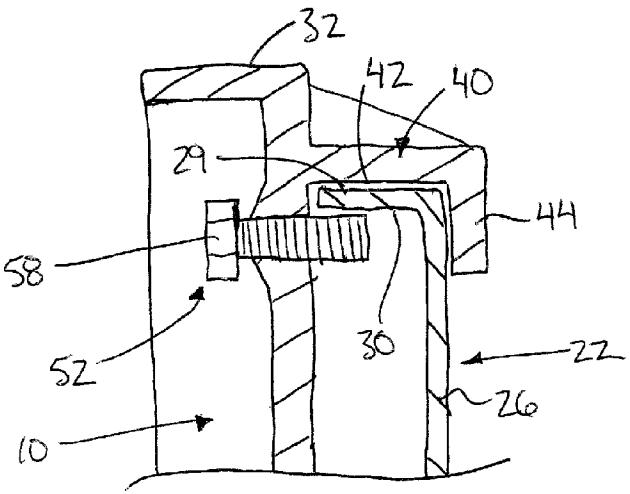
FIG. 6 is a partly sectional plan view of an alternative embodiment of the retainer member.
Figure 5:
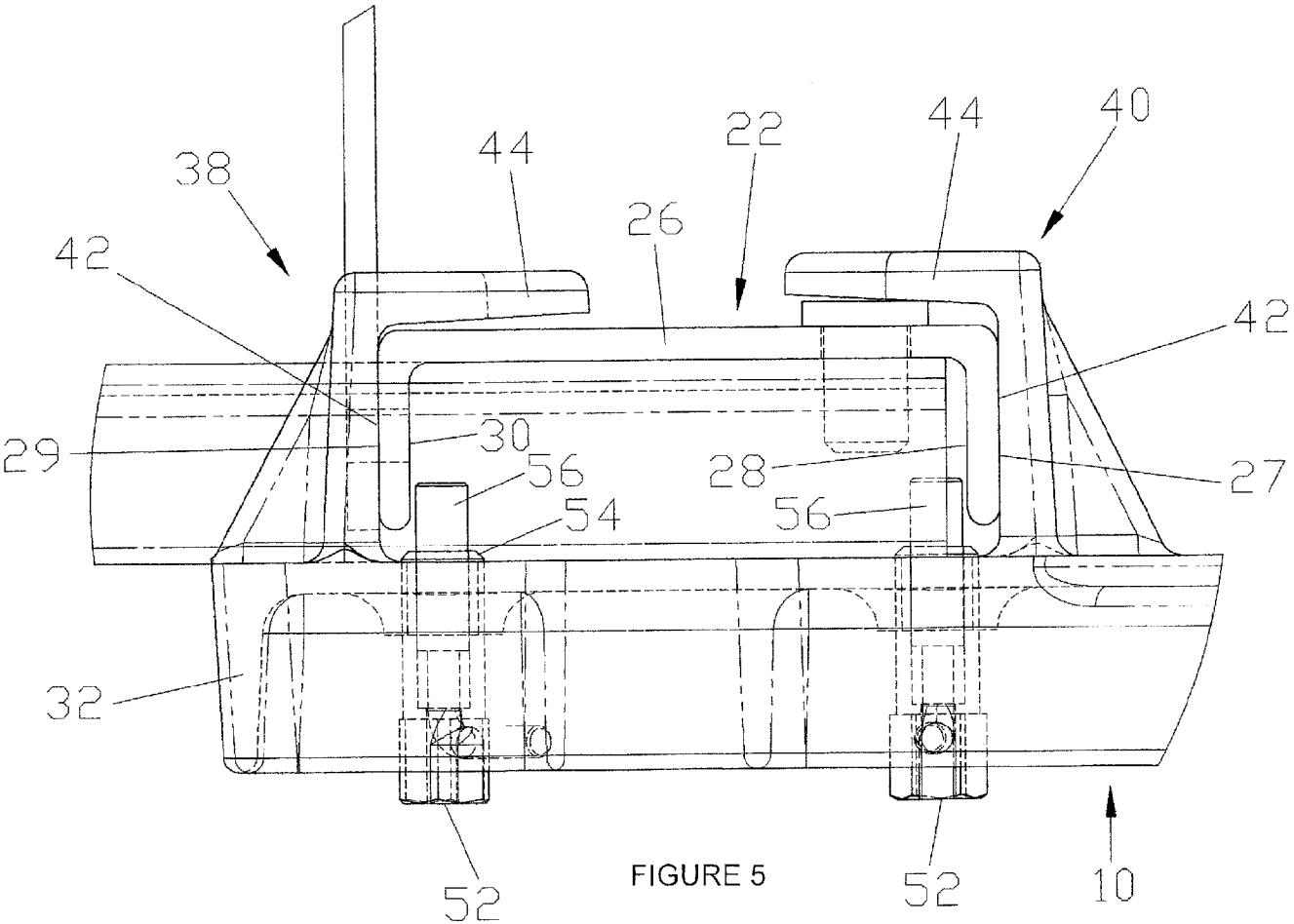
FIG. 5 is an enlarged top plan view of the hooks and retainer members of the brackets.

As shown in FIG. 6, the retainer members 52 may each comprise a simple threaded bolt 58 which is displaced axially by rotation thereof between a locked and engaged position overlapping the corresponding inner face of the C-channel and an unlocked and disengaged position in which the area between the confronting hooks is unobstructed for removing the bracket form the upright support by simple angular deflection thereof as in the previous embodiment. A suitable knob may be formed on the end of the bolt to permit rotation thereof readily by gripping with a person's hand.

Accordingly an auxiliary platform member is provided for a scaffolding system when two or more brackets are provided for mounting on the upright support of respective pump heads. By supporting the support arm to extend at an upward and outward incline, the nearest edges of the confronting hooks which are parallel to one another are oriented parallel to the upright support 22 for slidably receiving the support therein. Locating the retainer members 52 in an unlocked and disengaged position permits the bracket to be rotated into its in-use position as shown in the accompanying figures in which the support arm extends horizontally. The retainer members 52 are then displaced axially parallel to the inner faces of the upright support 22 to engage the faces in the locked and engaged position. The retainer members 52 are immovable in the direction of engagement of the members against the respective hooks to provide firm support against any angular rotation or deflection of the bracket which would otherwise cause release of the bracket from the upright support 22.

Figure 7:
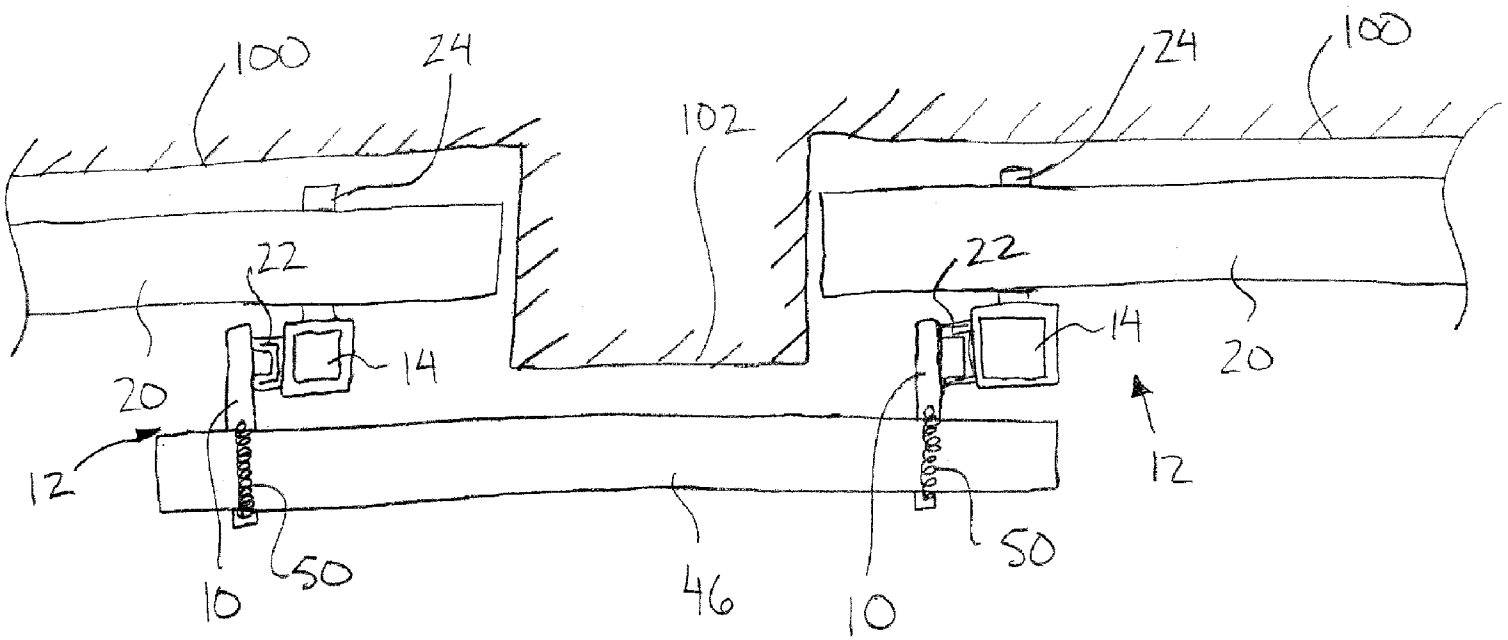
FIG. 7 is s schematic top plan view of the scaffolding system using the bracket according to the present invention for extending about an obstacle.

In one particularly advantageous configuration as shown in FIG. 7, the brackets 10 may be provided on a pair of adjacent scaffolding systems 12 each having their own uprights 14 adjacent an upright wall 100 which the scaffolding systems span. The scaffolding systems terminate at respective opposing sides of an obstacle 102 projecting outwardly from the wall 100. The brackets are similarly mounted to an upright scaffolding member 22 of the pump heads. The auxiliary platform surface 46 spanning the brackets 10 of the respective scaffolding systems 12, thus spans between the main platform surfaces 20 of the scaffolding systems 12 respectively.

While various embodiments of the present invention have been described in the foregoing, it is to be understood that other embodiments are possible within the scope of the invention. The invention is to be considered limited solely by the scope of the appended claims.

The invention claimed is:

1. A bracket for attachment to an upright scaffolding member, the bracket comprising:

a rigid body;

a front hook on the rigid body for engaging a front face of the upright scaffolding member;

a support arm projecting horizontally forward from the rigid body beyond the front hook;

a rear hook on the rigid body, spaced upwardly and rearwardly from the front hook, for engaging a rear face of the upright scaffolding member securable to the rigid body and;

a retainer member movable between an unlocked position in which an area between the hooks for receiving the upright scaffolding member therein is unobstructed and a locked position for engaging the upright scaffolding member in which the retainer member is immovable in the direction of engagement of the retainer member with the upright scaffolding member.

2. The bracket according to claim 1 wherein the retainer member is moveable perpendicularly to the direction of engagement of the retainer member with the upright scaffolding member.

3. The bracket according to claim 1 wherein the retainer member is adapted to engage a rearward facing edge of the upright scaffolding member.

4. The bracket according to claim 3 wherein the retainer member is positioned nearest the front hook.

5. The bracket according to claim 1 wherein the retainer member is adapted to engage a forward facing edge of the upright scaffolding member.

6. The bracket according to claim 5 wherein the retainer member is nearest to the rear hook.

7. The bracket according to claim 1 wherein the retainer member comprises a first member adapted to engage a rearward facing edge of the upright scaffolding member and a second member engaging a front facing edge of the upright scaffolding member.

8. The bracket according to claim 7 wherein the first member is located adjacent the front hook and the second member is located adjacent the rear hook.

9. The bracket according to claim 1 for an upright scaffolding member which is generally C-shaped in cross-section wherein the retainer member is adapted to engage an inner face of the upright scaffolding member adjacent one of the hooks.

10. The bracket according to claim 9 wherein the retainer member comprises a first member engaging an inner face of the upright scaffolding member adjacent the front hook and a second member adapted to engage an inner face of the upright support member adjacent the rear hook.

11. The bracket according to claim 1 wherein the retainer member comprises a threaded member, moveable axially by rotation thereof.

12. The bracket according to claim 1 wherein the retainer member is slidable perpendicularly to the direction of engagement of the retainer member with the uprights scaffolding member.

13. The bracket according to claim 12 wherein the retainer member is adapted to be biased into a locked and engaged position with the upright scaffolding member.

14. The bracket according to claim 1 wherein there is provided a mounting aperture at each end of the support arm for mounting a chain extending therebetween.

* * * * *